US011279154B2

(12) United States Patent
Shimomura

(10) Patent No.: US 11,279,154 B2
(45) Date of Patent: Mar. 22, 2022

(54) FRAME UNIT AND RECORDING APPARATUS

(71) Applicant: SEIKO EPSON CORPORATION, Tokyo (JP)

(72) Inventor: Masaki Shimomura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/984,480

(22) Filed: Aug. 4, 2020

(65) Prior Publication Data

US 2021/0039407 A1 Feb. 11, 2021

(30) Foreign Application Priority Data

Aug. 5, 2019 (JP) ..... JP2019-143586

(51) Int. Cl.
*B41J 2/175* (2006.01)
*B41J 13/10* (2006.01)
*B41J 29/02* (2006.01)

(52) U.S. Cl.
CPC ..... *B41J 13/103* (2013.01); *B41J 2/175* (2013.01); *B41J 29/02* (2013.01)

(58) Field of Classification Search
CPC ..... B41J 2/175; B41J 2/17509; B41J 13/10; B41J 29/02; B41J 13/103
See application file for complete search history.

(56) References Cited

U.S. PATENT DOCUMENTS 5,142,746 A * 9/1992 Morita ..... A41F 1/002 24/303
2019/0118542 A1 4/2019 Shimomura et al.

FOREIGN PATENT DOCUMENTS

JP 2019-077160 A 5/2019

* cited by examiner

*Primary Examiner* — Anh T Vo
(74) *Attorney, Agent, or Firm* — Workman Nydegger

(57) ABSTRACT

A frame unit includes a first member formed with a cutout portion, and a second member to be fixed to the first member. A first receiving portion and a second receiving portion are formed in the cutout portion, the second member includes a first facing portion facing the first receiving portion, a second facing portion facing the second receiving portion, and a protruding portion protruding toward the first plate portion. When the second member is attached to the first member, the protruding portion enters the cutout portion so that the first facing portion faces the first receiving portion and the second facing portion faces the second receiving portion.

20 Claims, 10 Drawing Sheets

FRAME UNIT AND RECORDING APPARATUS

The present application is based on, and claims priority from JP Application Serial Number 2019-143586, filed Aug. 5, 2019, the disclosure of which is hereby incorporated by reference herein in its entirety.

BACKGROUND

1. Technical Field

The present disclosure relates to a frame unit including a first member and a second member, and a recording apparatus that includes the frame unit and that performs recording on a medium.

2. Related Art

Some electric apparatuses include a lower structure and an upper structure, and have a configuration in which a frame of the lower structure receives the weight of the upper structure. JP-A-2019-077160 describes an example of such a configuration, and a liquid storage unit described in JP-A-2019-077160 corresponds to the lower structure, and a recording unit corresponds to the upper structure.

When coupling the lower structure and the upper structure with a flexible member such as a cable or a tube, if the flexible member is configured to be routed outside a corner portion of the frame included in the lower structure, the apparatus size becomes large. Therefore, it is conceivable to form an opening portion in the lower structure so that the flexible member is routed through the opening portion. However, in this case, it is necessary to couple the flexible member to the upper structure after routing the flexible member through the opening portion, and, inevitably, the process is set, and the degree of freedom in the assembly process is reduced.

In order to avoid such a problem, when a cutout portion is formed in the frame instead of an opening portion, and a flexible member is routed therethrough, due to the weight of the upper structure, there is a concern that the frame may become deformed in such a manner that the width of the cutout portion becomes narrow.

SUMMARY

According to an aspect of the present disclosure, a frame unit includes a first member having a first plate portion that extends in a first direction and that has a cutout portion extending in a second direction, which is a direction intersecting the first direction, and a second member having a second plate portion that extends in the first direction, the second member being fixed to the first member in a state in which the second plate portion faces the first plate portion, in which, the first plate portion includes a first receiving portion on one side, and a second receiving portion on another side at a position facing the first receiving portion, the first receiving portion and the second receiving portion being provided with the cutout portion in between, the second plate portion includes a first facing portion facing the first receiving portion of the first member, a second facing portion facing the second receiving portion, and a protruding portion protruding toward the first plate portion, and when the second member is attached to the first member, the protruding portion enters the cutout portion so that the first facing portion faces the first receiving portion, and the second facing portion faces the second receiving portion.

DESCRIPTION OF EXEMPLARY EMBODIMENTS

Figure 1:
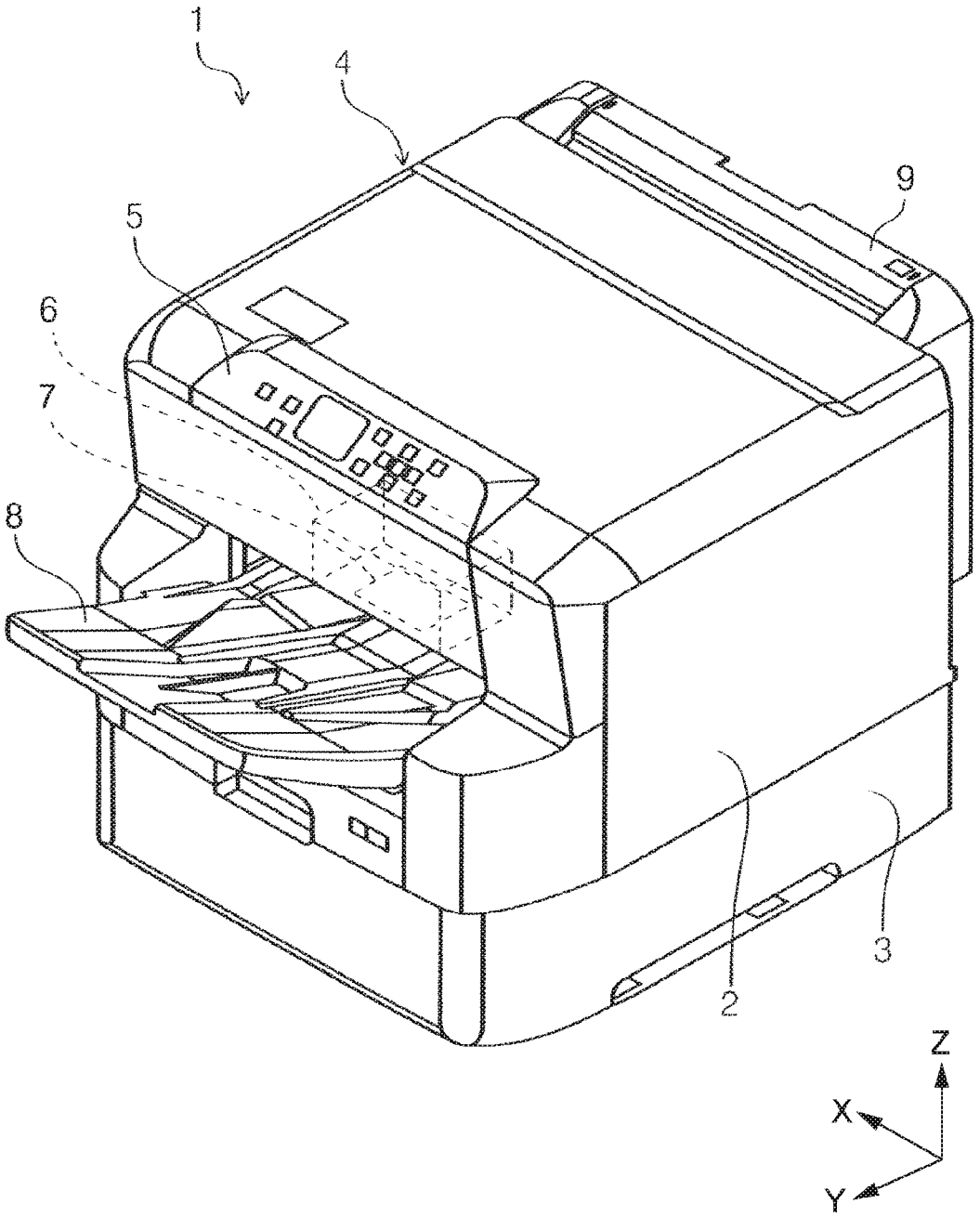
FIG. 1 is an external perspective view of a printer.

Hereinafter, the present disclosure will be schematically described.

According to a first aspect of the present disclosure, a frame unit includes a first member having a first plate portion that extends in a first direction and that has a cutout portion extending in a second direction, which is a direction intersecting the first direction, and a second member having a second plate portion that extends in the first direction, the second member being fixed to the first member in a state in which the second plate portion faces the first plate portion, in which, the first plate portion includes a first receiving portion on one side, and a second receiving portion on another side at a position facing the first receiving portion, the first receiving portion and the second receiving portion being provided with the cutout portion in between, the second plate portion includes a first facing portion facing the first receiving portion of the first member, a second facing portion facing the second receiving portion, and a protruding portion protruding toward the first plate portion, and when the second member is attached to the first member, the protruding portion enters the cutout portion so that the first facing portion faces the first receiving portion, and the second facing portion faces the second receiving portion.

According to this aspect, since the first member is provided with a first plate portion that extends in a first direction and that has a cutout portion extending in a second direction, which is a direction intersecting the first direction, the degree of freedom in the assembly process of the apparatus is improved by routing the flexible member through the cutout portion.

Since the second member having the second plate portion is fixed to the first member in a state in which the second plate portion is facing the first plate portion, and, when the second member is attached to the first member, the protruding portion enters the cutout portion so that the first facing portion faces the first receiving portion and the second facing portion faces the second receiving portion, the protruding portion can suppress a decrease in the width of the cutout portion, that is, suppress deformation of the first member.

In a second aspect according to the first aspect, when fixing of the second member to the first member is completed, the first facing portion is in contact with the first receiving portion, and the second facing portion is in contact with the second receiving portion.

According to this aspect, when the fixing of the second member to the first member has been completed, since the first facing portion and the first receiving portion are in contact with each other, and the second facing portion and the second receiving portion are in contact with each other, after fixing of the second member to the first member has been completed, deformation of the first member can be substantially eliminated.

In a third aspect according to the second aspect, the protruding portion includes a first inclined portion that guides, when the second member is to be attached to the first member, the first facing portion to the first receiving portion, and a second inclined portion that guides, when the second member is to be attached to the first member, the second facing portion to the second receiving portion.

According to this aspect, when the second member is to be attached to the first member, the protruding portion is less likely to be caught in the cutout portion due to the first inclined portion and the second inclined portion, thereby facilitating assembly.

In a fourth aspect according to the third aspect, the second member is fixed to the first member by screwing the second plate portion to the first plate portion, and, in a process of the fixing by screwing, the protruding portion enters the cutout portion while the first inclined portion and the second inclined portion expand a gap between the first receiving portion and the second receiving portion.

According to this aspect, since the second member is fixed to the first member by screwing the second plate portion to the first plate portion, and, in the process of fixing by screwing, the protruding portion enters the cutout portion while the first inclined portion and the second inclined portion expand the gap between the first receiving portion and the second receiving portion, when attaching the second member to the first member, even if the gap between the first receiving portion and the second receiving portion has been reduced due to deformation of the first member, the protruding portion can easily enter the cutout portion.

In a fifth aspect according to the first to fourth aspects, the first receiving portion of the first member is provided in a first groove portion extending in the first direction, the second receiving portion of the first member is provided in a second groove portion extending in the first direction, and when the second member is attached to the first member, the protruding portion enters the first groove portion and the second groove portion.

According to this aspect, since the protruding portion enters the first groove portion and the second groove portion extending in the first direction, the displacement of the position of the second member with respect to the first member in the second direction, which is a direction intersecting the first direction, can be corrected.

In a sixth aspect according to the fifth aspect, the first groove portion of the first receiving portion and the second groove portion of the second receiving portion include restricting portions that protrude inside the first groove portion and the second groove portion, and the restricting portions sandwich the protruding portion.

According to this aspect, it is possible to more reliably correct the displacement of the position of the second member with respect to the first member in the second direction, which is a direction intersecting the first direction.

In a seventh aspect according to any one of the first to sixth aspects, the second member is attached to the first member from an outer surface side of the first plate portion.

According to this aspect, since the second member is attached to the first member from the outer surface side of the first plate portion, the second member can be attached to the first member by simple operation.

In an eighth aspect according to any one of the first to sixth aspects, the second member is attached to the first member from an inner surface side of the first plate portion.

According to this aspect, since the second member is attached to the first member from the inner surface side of the first plate portion, it is possible to save space on the outer surface side of the first plate portion and suppress an increase in the size of the device.

In a ninth aspect according to any one of the first to eighth aspects, the first direction is a vertical direction.

According to this aspect, since the first direction is a vertical direction, when the first member receives the weight of the upper structure, the first member may be deformed so that the width of the cutout portion is reduced; however, the deformation of the first member can be effectively suppressed by the second member.

In a tenth aspect according to any one of the first to ninth aspects, the first member includes, on one side of the first plate portion in the second direction, a third plate portion that extends in a direction intersecting a plate surface of the first plate portion, and, on another side of the first plate portion in the second direction, a fourth plate portion that extends in the direction intersecting the plate surface of the first plate portion, and the second member includes a fifth plate portion facing, when the second member is attached to the first member, the third plate portion and a sixth plate portion facing, when the second member is attached to the first member, the fourth plate portion.

According to this aspect, because the second member, while attached to the first member, has a fifth plate portion facing the third plate portion and a sixth plate portion facing the fourth plate portion, it is possible to restrict the position of the second member with respect to the first member in the second direction, which is a direction intersecting the first direction. In addition, the rigidity of the second member can be effectively improved.

According to an eleventh aspect of the present disclosure, a recording apparatus includes a recording unit including a recording portion that performs recording by ejecting liquid onto a medium, and a liquid housing unit that houses the liquid to be supplied to the recording portion and that is located under the recording unit, in which the liquid housing unit includes the frame unit according to any one of the first to tenth aspects.

According to this aspect, in the recording apparatus, the operation and effect of any of the above-described first to tenth aspects can be obtained.

In a twelfth aspect according to the eleventh aspect, the recording apparatus further includes a tube that supplies the liquid from the liquid housing unit to the recording portion, in which the tube is routed through the cutout portion.

According to this aspect, since the recording apparatus further includes a tube that supplies the liquid from the liquid housing unit to the recording portion, in which the tube is routed through the cutout portion, the degree of freedom in the assembly process of the device is improved by routing the tube through the cutout portion.

Hereinafter, the present disclosure will be specifically described.

Hereinafter, an ink jet printer 1 will be described as an example of a recording apparatus. Hereinafter, the ink jet printer 1 will simply be referred to as the printer 1.

Further, in the XYZ coordinate system illustrated in each figure, the X-axis direction is the scanning direction of a recording head 7, the width direction of recording paper on which recording is performed, and the apparatus width direction. The +X direction is the left direction when facing the printer 1, and the −X direction is the right direction. In addition, the X-axis direction is an example of a second direction that is a direction intersecting the Z-axis direction.

The Y-axis direction is a depth direction of the apparatus, and is generally a direction along the sheet transport direction used when recording. The +Y direction is a direction from the rear of the apparatus to the front, and the −Y direction is a direction from the front of the apparatus to the rear. In the present embodiment, among the side surfaces constituting the periphery of the printer 1, the side surface on which a discharge tray 8 is provided is the front surface of the apparatus.

The Z-axis direction is an example of a first direction, and in the present embodiment, the Z-axis direction is a direction along a vertical direction, and is an apparatus height direction. The +Z direction is a vertically upward direction, and the −Z direction is a vertically downward direction.

In FIG. 1, the printer 1 includes a recording unit 2, a liquid storage unit 3, and a scanner portion 4.

The recording unit 2 includes therein the recording head 7 for recording on a recording sheet as an example of a medium, and various components including a transport path (not illustrated) along which the recording sheet is transported.

The recording head 7 is mounted on a carriage 6 that can move in the X-axis direction, and is configured as a so-called ink jet head that performs recording by ejecting ink, which is an example of a liquid, onto recording paper while moving in the X-axis direction.

The liquid storage unit 3 stores liquid housing bodies (not illustrated) that house ink to be supplied to the recording head 7 for each ink color. The ink is supplied from the liquid housing bodies stored in the liquid storage unit 3 to the recording head 7 via a tube 12 (refer to FIG. 3).

An upper cover 9 is provided on a rear surface side of the scanner portion 4 so as to be openable and closable, and, by opening the upper cover 9, it is possible to set recording paper on a paper setting portion (not illustrated) for setting recording paper.

The discharge tray 8 is provided on a front surface of the recording unit 2, and the recording paper on which recording has been performed is discharged toward the discharge tray 8 by a discharger (not illustrated).

The printer 1 is configured as a multifunction machine having not only a recording function but also a document reading function, that is, a scanner unit. In the present embodiment, the scanner portion 4 is provided in an upper portion of the recording unit 2.

An operating portion 5 for operating the printer 1 including the scanner portion 4 is provided at the upper front of the apparatus.

Next, a frame unit 14 will be described with reference to FIG. 2.

Figure 2:
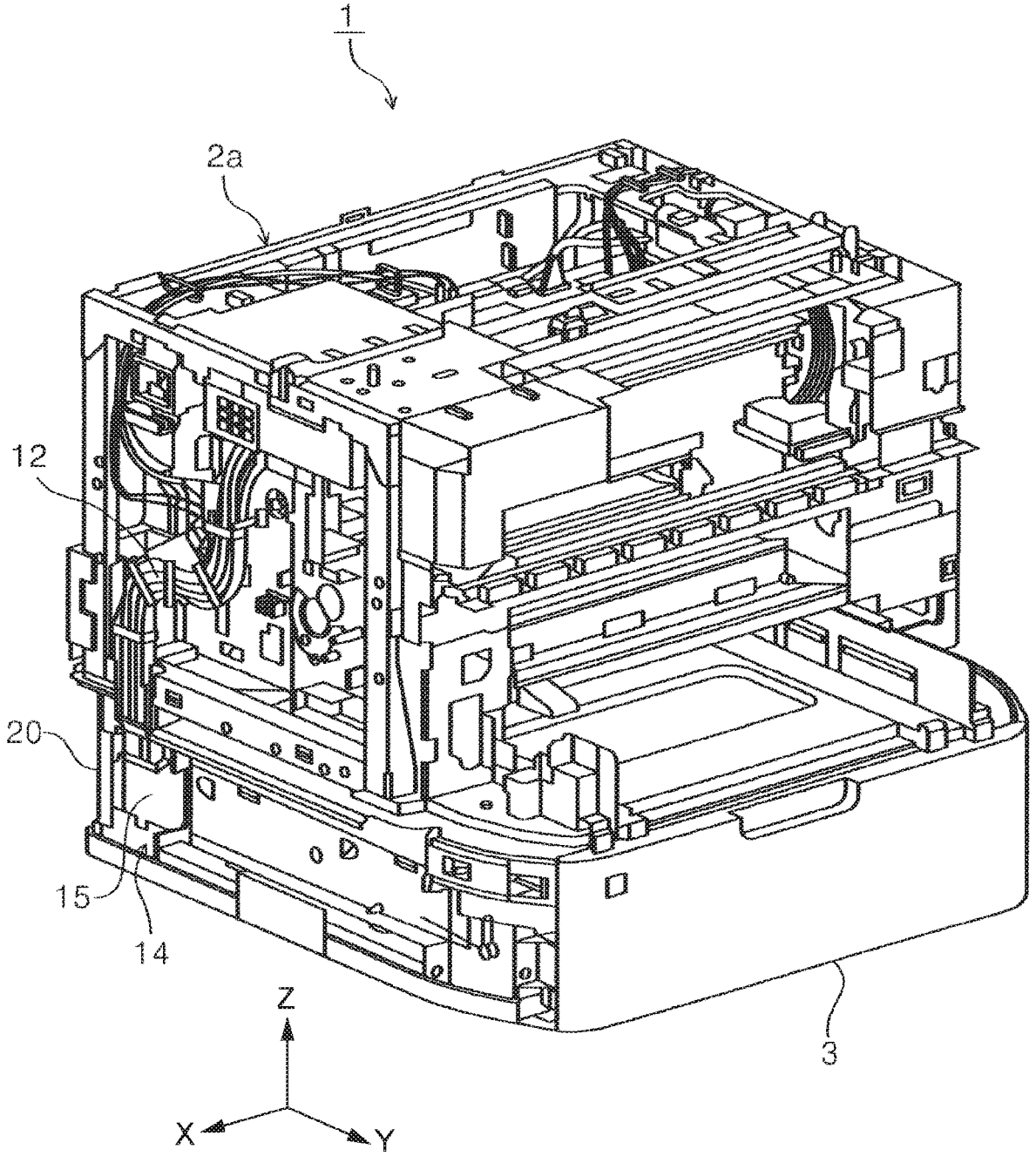
FIG. 2 is a perspective view illustrating a state in which a casing constituting an outer shell of the printer is removed.
Figure 3:
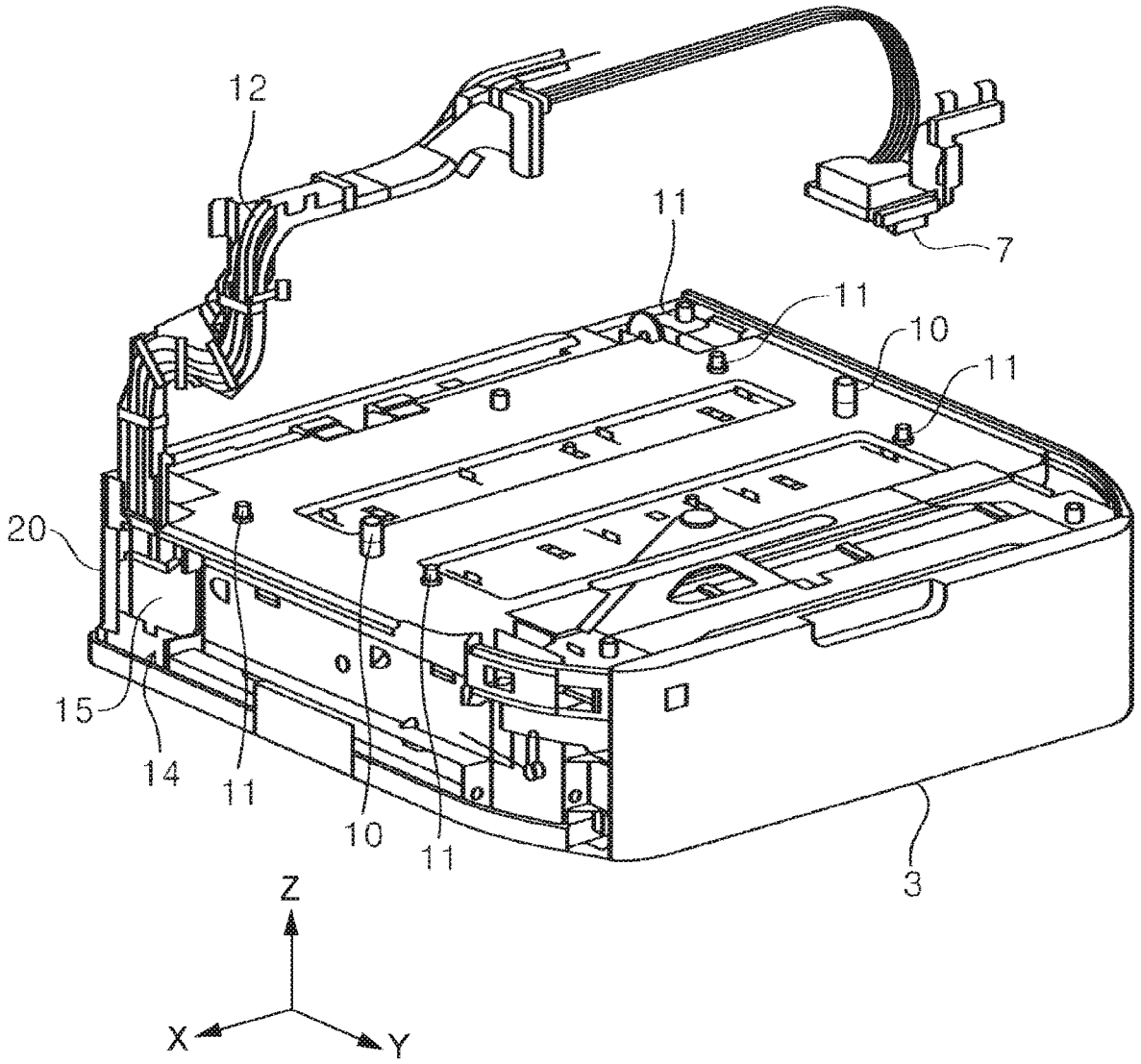
FIG. 3 is a perspective view of a liquid storage unit, a tube, and a recording head.

In FIG. 2, reference sign 2*a* indicates an apparatus main body of the recording unit 2, and the apparatus main body 2*a* is supported by the liquid storage unit 3. As illustrated in FIG. 3, the liquid storage unit 3 includes three support bosses 11 on the −X direction side along the Y-axis direction, and, in addition, three support bosses 11 on the +X direction side along the Y-axis direction, and the apparatus main body 2*a* is supported in the Z-axis direction by the six support bosses 11 provided in the liquid storage unit 3. The apparatus main body 2*a* is provided with fitting portions (not illustrated) that fit onto the support bosses 11.

Figure 5:
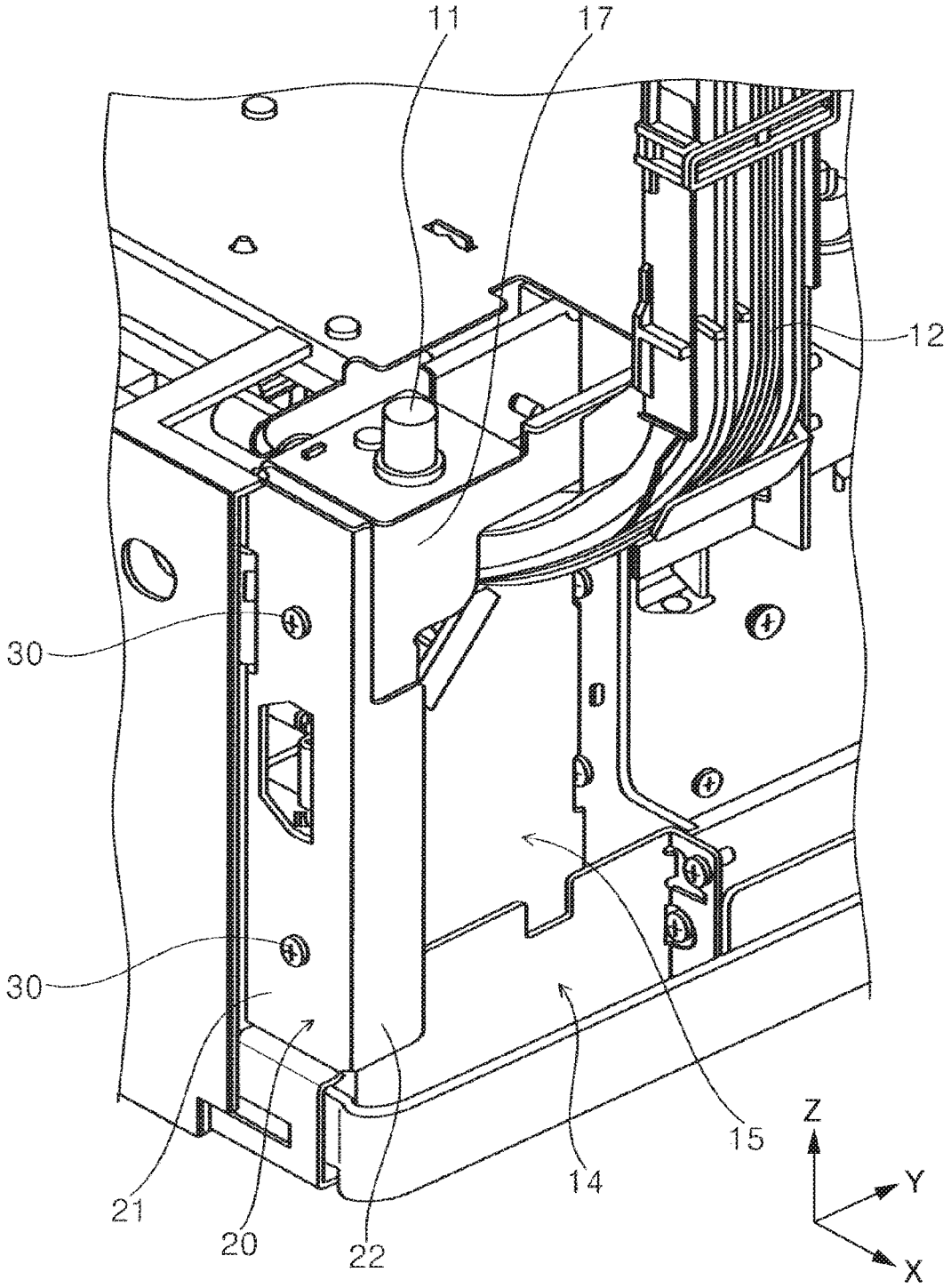
FIG. 5 is a perspective view of the frame unit.

Further, in FIG. 3, one of the three support bosses 11 disposed in the +X direction is hidden behind the tube 12 in the −Y direction, and this support boss 11 is illustrated in FIG. 5.

In addition, the liquid storage unit 3 includes one positioning boss 10 on the −X direction side, and one positioning boss 10 on the +X direction side, and the position of the apparatus main body 2*a* with respect to the liquid storage unit 3 is restricted in the X-axis direction and the Y-axis direction by the two positioning bosses 10 provided in the liquid storage unit 3. The apparatus main body 2*a* is provided with fitting portions (not illustrated) that fit onto the positioning bosses 10.

Further, it is needless to say that the number and positions of the support bosses 11 and the positioning bosses 10 can be changed as appropriate.

The liquid storage unit 3 has a skeleton composed of a plurality of metal frames, and a corner portion situated at an end portion in the +X direction and an end portion in the −Y direction includes the frame unit 14.

The frame unit 14 includes a first frame 15 as a first member, and a second frame 20 as a second member, and as illustrated in FIG. 5, the frame unit 14 is provided with one support boss 11 at a +Z direction end portion of the first frame 15, that is, some of the weight of the recording unit 2 is applied to the frame unit 14.

Figure 6:
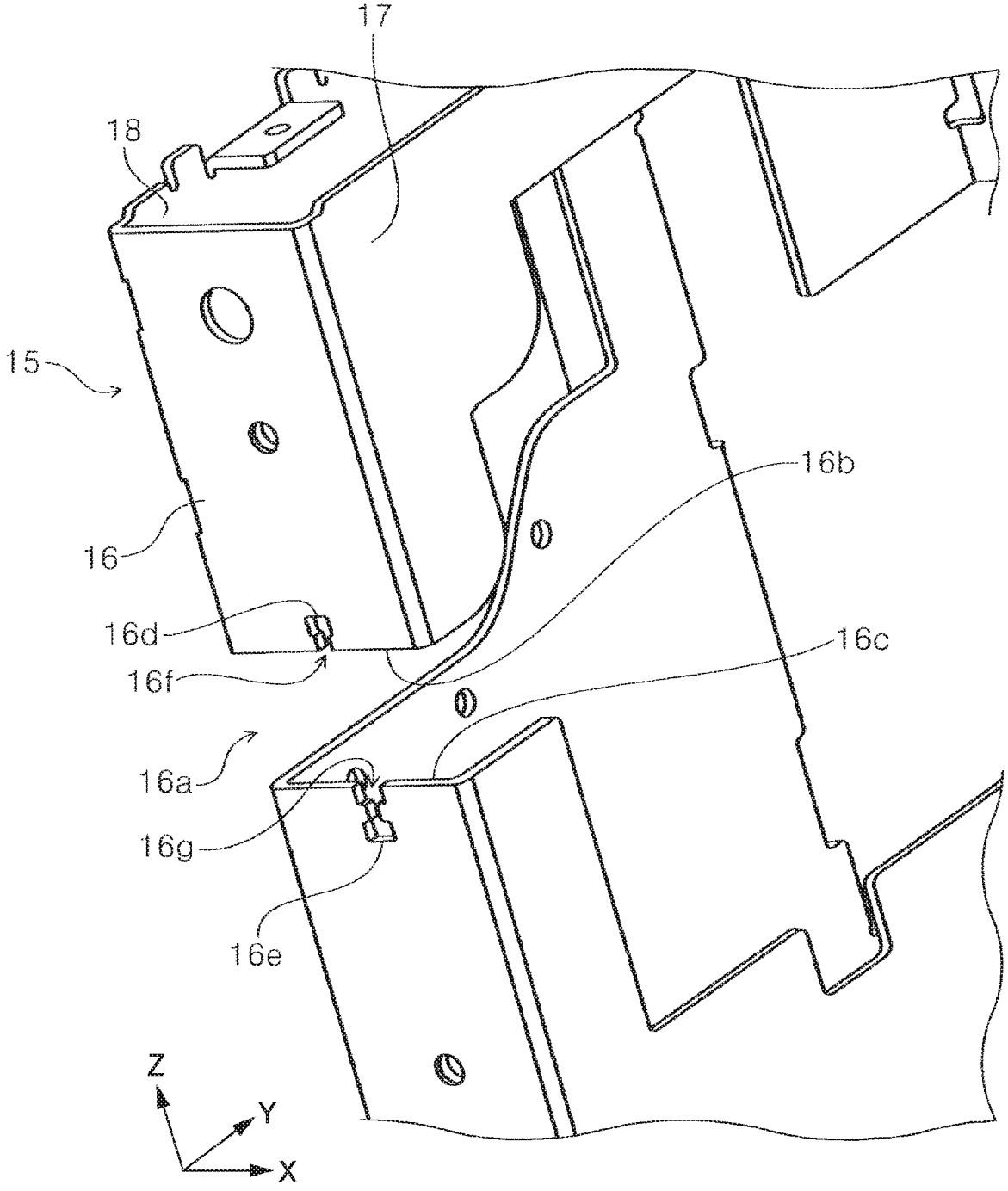
FIG. 6 is a perspective view of a first frame.

The first frame 15 includes a first plate portion 16 that extends in the X-axis direction as illustrated in FIG. 6, a third plate portion 17 that is provided on one side of the first plate portion 16 in the X-axis direction and that extends in the Y-axis direction, which intersects a plate surface of the first plate portion 16, and a fourth plate portion 18 that is provided on another side of the first plate portion 16 in the X-axis direction and that extends in the Y-axis direction. In the present embodiment, the third plate portion 17 and the fourth plate portion 18 of the first frame 15 are formed by bending a metal plate.

Figure 4:
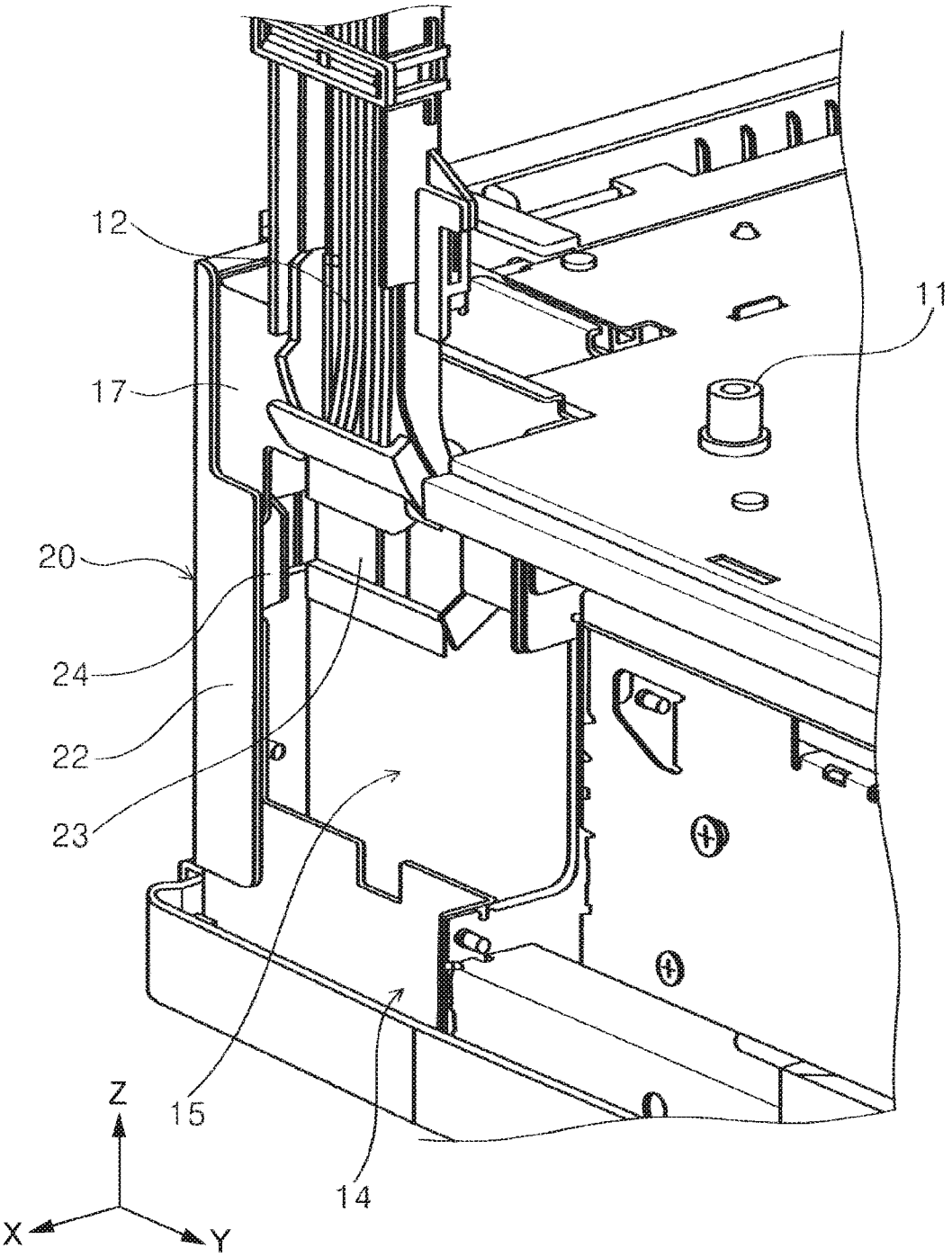
FIG. 4 is a perspective view of a frame unit.

In the first frame 15, a cutout portion 16*a* is formed so as to extend across the first plate portion 16, the third plate portion 17, and the fourth plate portion 18 in the X axis direction, in other words, so as to extend in the X-axis direction. The tube 12 coupling the liquid storage unit 3 and the recording head 7 is routed through the cutout portion 16*a* to the inside of the first frame 15 as illustrated in FIG. 4.

A first groove portion 16*f* extending in the +Z direction is formed at a first edge 16*b*, which is an upper edge of the cutout portion 16*a*, and a first receiving portion 16*d* is formed at an end portion of the first groove portion 16*f*.

In addition, a second groove portion 16*g* extending in the −Z direction is formed in a second edge 16*c*, which is a lower edge of the cutout portion 16*a*, and a second receiving portion 16*e* is formed at an end portion of the second groove portion 16*g*.

That is, the first receiving portion 16*d* is formed on one side of the cutout portion 16*a*, and the second receiving portion 16*e* is formed on another side of the cutout portion 16*a* at a position facing the first receiving portion 16*d*.

Figure 7:
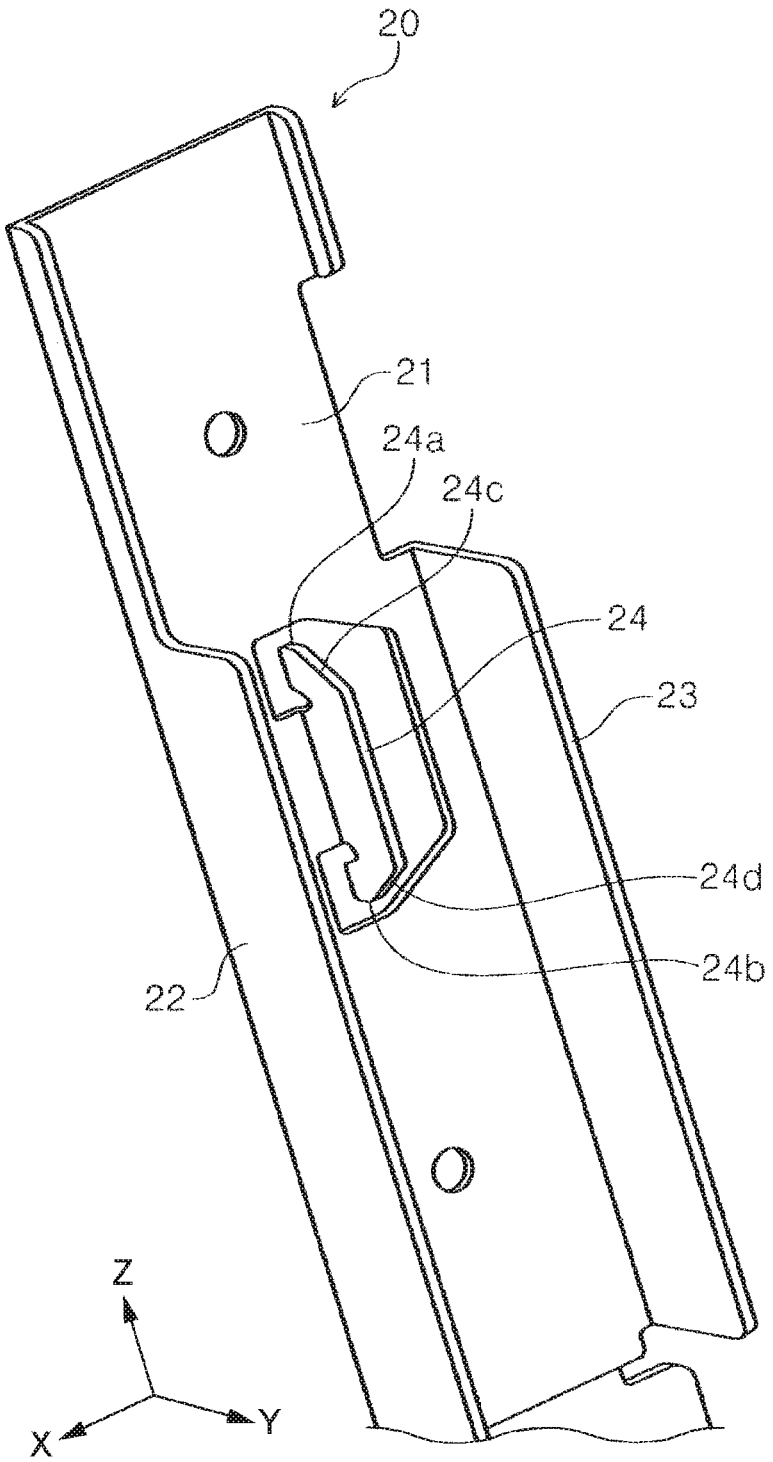
FIG. 7 is a perspective view of a second frame.

However, the second frame 20, as the second member, includes a second plate portion 21 that extends in the Z-axis direction as illustrated in FIG. 7, a fifth plate portion 22 that is provided on one side of the second plate portion 21 in the X-axis direction and that extends in the Y-axis direction, which intersects a plate surface of the second plate portion 21, and a sixth plate portion 23 that is provided on another side of the second plate portion 21 in the X-axis direction and that extends in the Y-axis direction. In this embodiment, the fifth plate portion 22 and the sixth plate portion 23 of the second frame 20 are formed by bending a metal plate.

The second frame 20 is attached from outside the first frame 15 as illustrated in FIGS. 4 and 5, and is fixed by two screws 30. In a state in which the second frame 20 is attached to the first frame 15, the first plate portion 16 of the first frame 15 faces the second plate portion 21 of the second frame 20. In addition, the third plate portion 17 of the first frame 15 faces the fifth plate portion 22 of the second frame 20. In addition, the fourth plate portion 18 of the first frame 15 faces the sixth plate portion 23 of the second frame 20.

In other words, the second frame 20 is attached so as to cover the first frame 15 from the outside.

As illustrated in FIG. 7, the second frame 20 includes a first facing portion 24*a* facing the first receiving portion 16*d* (refer to FIG. 6) of the first frame 15 and a second facing portion 24*b* facing the second receiving portion 16*e* (refer to FIG. 6) and is provided with a protruding portion 24 protruding toward the first plate portion 16 (refer to FIG. 6) of the first frame 15. In the present embodiment, the protruding portion 24 is provided integrally with the second plate portion 21 by bending a metal plate material.

Figure 8:
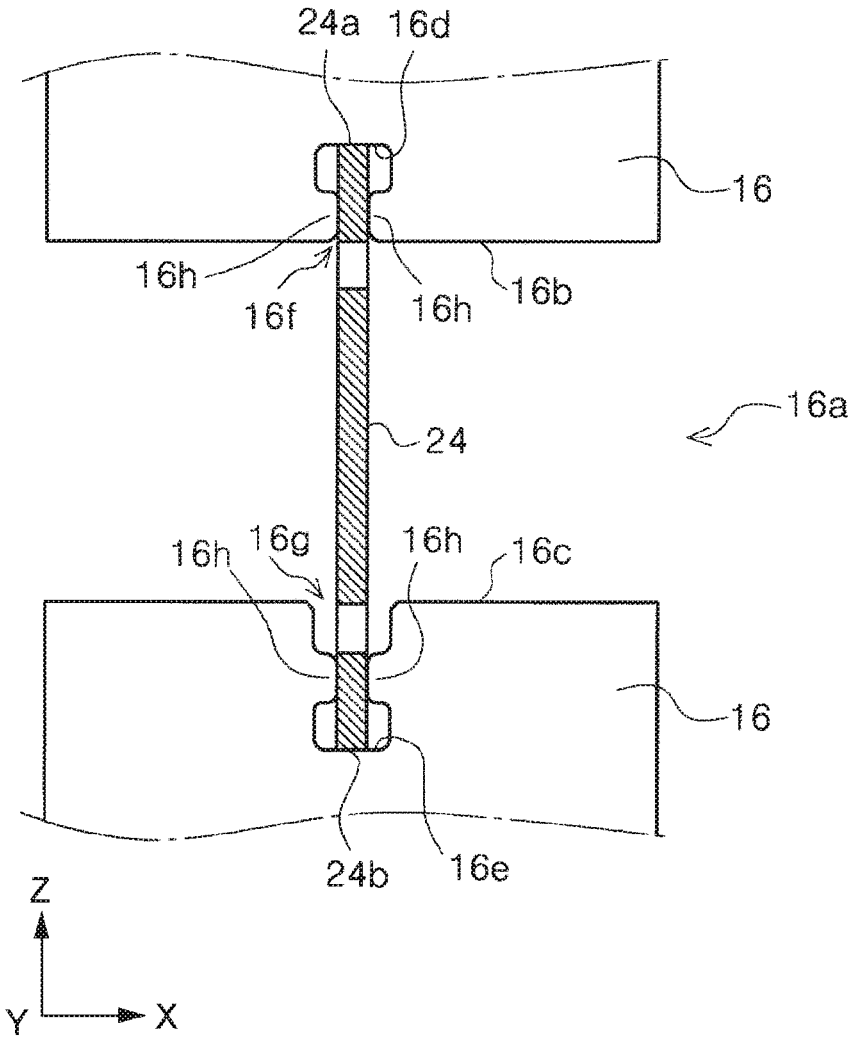
FIG. 8 is a sectional view of the frame unit.
Figure 9:
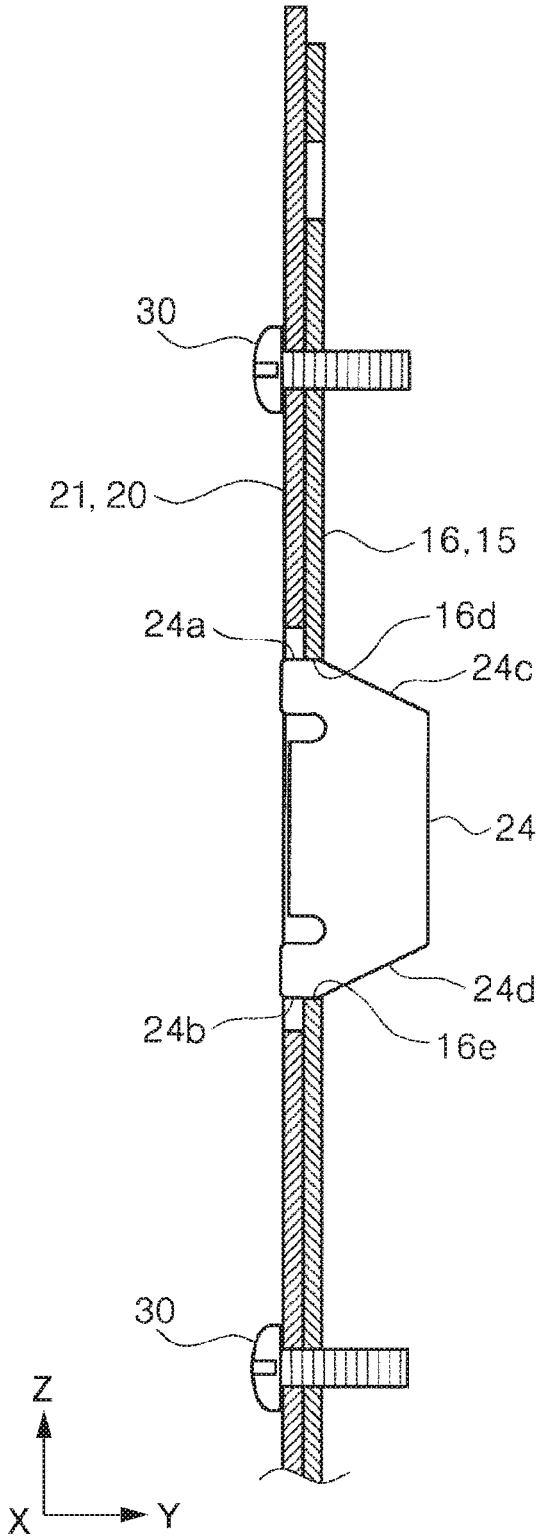
FIG. 9 is a sectional view of the frame unit.

Then, as illustrated in FIGS. 8 and 9, by attaching the second frame 20 to the first frame 15, the protruding portion 24 enters the cutout portion 16*a* so that the first facing portion 24*a* faces the first receiving portion 16*d*, and the second facing portion 24*b* faces the second receiving portion 16*e*.

Because, the first frame 15 is provided with the cutout portion 16*a* extending in the X-axis direction as described above, the degree of freedom in the assembly process of the device is improved by routing the tube 12 (refer to FIGS. 4 and 5), which is an example of a flexible member, through the cutout portion 16*a*. That is, the tube 12 can be routed inside the first frame 15 while the liquid storage unit 3 and the recording head 7 are coupled as illustrated in FIG. 3.

Then, since the protruding portion 24 enters the cutout portion 16*a* so that the first facing portion 24*a* faces the first receiving portion 16*d*, and the second facing portion 24*b* faces the second receiving portion 16*e* upon attachment of the second frame 20 to the first frame 15 as illustrated in FIGS. 8 and 9, the protruding portion 24 can suppress a decrease in the width of the cutout portion 16*a* in the Z-axis direction, that is, deformation of the first frame 15 can be suppressed.

In this embodiment, when fixing of the second frame 20 to the first frame 15 has been completed, as illustrated in FIGS. 8 and 9, the first facing portion 24*a* is in contact with the first receiving portion 16*d*, and the second facing portion 24*b* is in contact with the second receiving portion 16*e*. Thereby, the deformation of the first frame 15 after fixing of the second frame 20 to the first frame 15 has been completed can be almost eliminated.

In addition, when the second frame 20 is attached to the first frame 15, the protruding portion 24 has a first inclined portion 24*c* that guides the first facing portion 24*a* to the first receiving portion 16*d*, and a second inclined portion 24*d* that guides the second facing portion 24*b* to the second receiving portion 16*e* as illustrated in FIGS. 7 and 9. Thereby, when attaching the second frame 20 to the first frame 15, the protruding portion 24 is less likely to be caught by the cutout portion 16*a* and assembly is facilitated.

In this embodiment, the second frame 20 is fixed to the first frame 15 by the second plate portion 21 being fixed to the first plate portion 16 by screwing, and, in the process of fixing by screwing, the first inclined portion 24*c* and the second inclined portion 24*d* expand the gap between the first receiving portion 16*d* and the second receiving portion 16*e*, specifically, the gap in the Z-axis direction, and the protruding portion 24 enters the cutout portion 16*a*.

Thus, when attaching the second frame 20 to the first frame 15, even if the gap between the first receiving portion 16*d* and the second receiving portion 16*e* has been reduced due to deformation of the first frame 15, the protruding portion 24 can easily enter the cutout portion 16*a*.

In addition, in this embodiment, the first receiving portion 16*d* of the first frame 15 is provided in the first groove portion 16*f* extending in the Z-axis direction, the second receiving portion 16*e* of the first frame 15 is provided in a second groove portion 16*g* extending in the Z-axis direction, and when the second frame 20 is attached to the first frame 15, the protruding portion 24 enters the first groove portion 16*f* and the second groove portion 16*g*.

In addition, the first groove portion 16*f* and the second groove portion 16*g* are formed with restricting portions 16*h* that protrude inside the groove portions, and the protruding portion 24 is sandwiched between the restricting portions 16*h*. Thereby, the displacement of the position of the second frame 20 in the X-axis direction with respect to the first frame 15 can be corrected.

Further, it is preferable that the groove portion width of the first groove portion 16*f* and the second groove portion 16*g*, specifically, the gap in the X-axis direction of the facing restricting portion 16*h*, be set so that the protruding portion 24 can enter the first groove portion 16*f* and the second groove portion 16*g*, and that the gap leave a slight margin with respect to the plate thickness of the protruding portion 24 so that the protruding portion 24 does not become loose after assembly.

Further, in the present embodiment, the second frame 20 is configured to be attached to the first frame 15 from the outer surface side of the first plate portion 16, that is, the surface in the −Y direction. Thus, the second frame 20 can be attached to the first frame 15 by simple operation.

Figure 10:
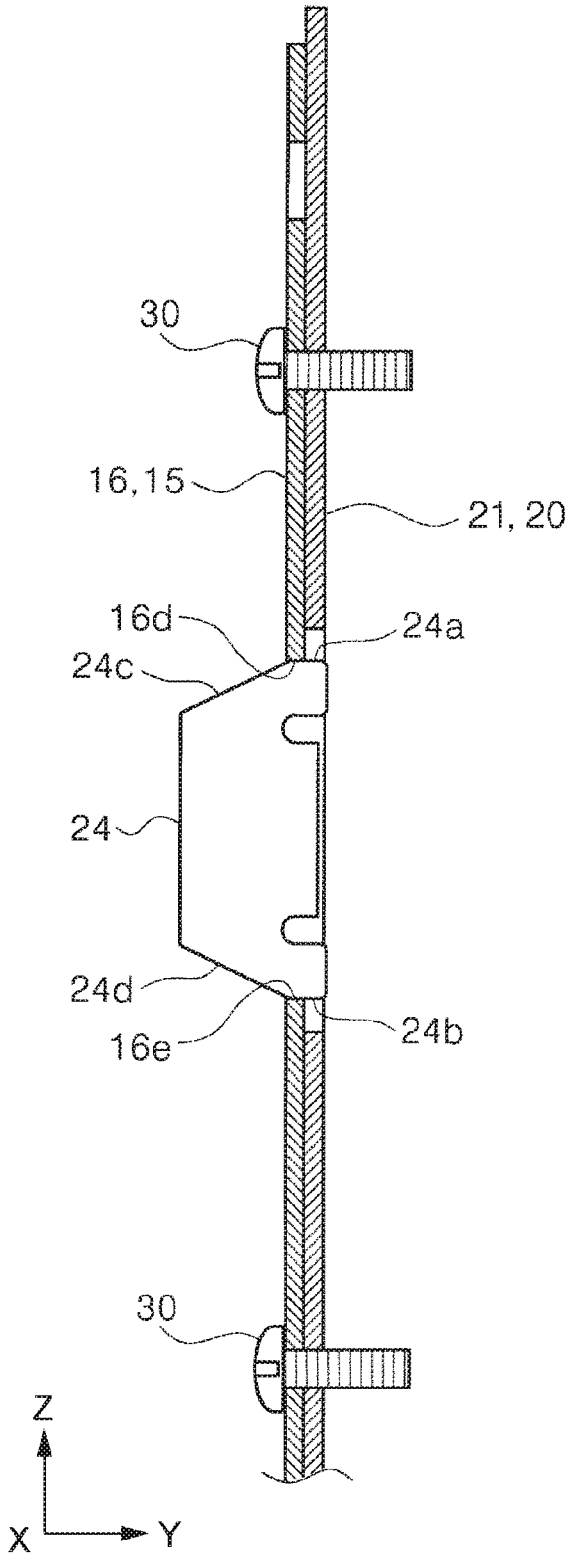
FIG. 10 is a sectional view of a frame unit according to some embodiments.

Further, instead of such a configuration, the second frame 20 may be attached to the first frame 15 from the inner surface side of the first plate portion 16, that is, the surface in the +Y direction, as illustrated in FIG. 10. With such a configuration, the space on the outer surface side of the first plate portion 16 can be saved, and an increase in the size of the device can be suppressed.

In addition, in the present embodiment, since the Z-axis direction, which is the direction in which the first plate portion 16 extends, is a vertical direction, when the first frame 15 receives the weight of the recording unit 2 as an upper structure, the first frame 15 may become deformed in such a manner that the width of the cutout portion 16*a* in the Z-axis direction becomes narrow. However, the deformation of the first frame 15 can be effectively suppressed by the second frame 20.

In addition, with the second frame 20 attached to the first frame 15, the third plate portion 17 of the first frame 15 faces the fifth plate portion 22 of the second frame 20, and the fourth plate portion 18 of the first frame 15 faces the sixth plate portion 23 of the second frame 20. In other words, the second frame 20 is attached so as to cover the first frame 15 from the outside. Thus, the position of the second frame 20 with respect to the first frame 15 in the X-axis direction can be restricted. In addition, the rigidity of the second frame 20 can be effectively improved.

It goes without saying that the present disclosure is not limited to the above embodiment, and various modifications are possible within the scope of the disclosure described in the claims, and they are also included in the scope of the present disclosure.

For example, in the present embodiment, the frame unit 14 is disposed for the purpose of routing the tube 12, but may be disposed for the purpose of routing other flexible members, for example, cables. In addition, in the present embodiment, the frame unit 14 is disposed at one of the four corners of the liquid storage unit 3; however, the frame unit 14 may be disposed at another corner, or may be disposed at two or more corners.

In addition, the first groove portion 16*f* and the second groove portion 16*g* need not be provided, and the first edge 16*b* may function as the first receiving portion 16*d*, and the second edge 16*c* may function as the second receiving portion 16*e*. In addition, in the above embodiment, only one protruding portion 24 is provided; however, two or more may be provided.

What is claimed is:

1. A frame unit comprising:

a first member having a first plate portion that extends in a first direction and that has a cutout portion extending in a second direction, which is a direction intersecting the first direction; and a second member having a second plate portion that extends in the first direction, the second member being fixed to the first member in a state in which the second plate portion faces the first plate portion, wherein the first plate portion includes a first receiving portion on one side of the cutout portion and that is formed in the first plate portion, and a second receiving portion on another side of the cutout and that is formed in the first plate portion at a position facing the first receiving portion, the first receiving portion and the second receiving portion being provided with the cutout portion in between, the second plate portion includes a first facing portion facing the first receiving portion of the first member, a second facing portion facing the second receiving portion, and a protruding portion protruding toward the first plate portion, and when the second member is attached to the first member, the protruding portion enters the cutout portion so that the first facing portion faces the first receiving portion, and the second facing portion faces the second receiving portion.

2. The frame unit according to claim 1, wherein when fixing of the second member to the first member is completed, the first facing portion is in contact with the first receiving portion, and the second facing portion is in contact with the second receiving portion.

3. The frame unit according to claim 2, wherein the protruding portion includes a first inclined portion that guides, when the second member is to be attached to the first member, the first facing portion to the first receiving portion, and a second inclined portion that guides, when the second member is to be attached to the first member, the second facing portion to the second receiving portion.

4. The frame unit according to claim 3, wherein the second member is fixed to the first member by screwing the second plate portion to the first plate portion, and in a process of the fixing by screwing, the protruding portion enters the cutout portion while the first inclined portion and the second inclined portion expand a gap between the first receiving portion and the second receiving portion.

5. The frame unit according to claim 1, wherein the first receiving portion of the first member is provided in a first groove portion extending in the first direction, the second receiving portion of the first member is provided in a second groove portion extending in the first direction, and when the second member is attached to the first member, the protruding portion enters the first groove portion and the second groove portion.

6. The frame unit according to claim 5, wherein the first groove portion of the first receiving portion and the second groove portion of the second receiving portion include restricting portions that protrude inside the first groove portion and the second groove portion, and the restricting portions sandwich the protruding portion.

7. The frame unit according to claim 1, wherein the second member is attached to the first member from an outer surface side of the first plate portion.

8. The frame unit according to claim 1, wherein the second member is attached to the first member from an inner surface side of the first plate portion.

9. The frame unit according to claim 1, wherein the first direction is a vertical direction.

10. The frame unit according to claim 1, wherein the first member includes, on one side of the first plate portion in the second direction, a third plate portion that extends in a direction intersecting a plate surface of the first plate portion, and, on another side of the first plate portion in the second direction, a fourth plate portion that extends in the direction intersecting the plate surface of the first plate portion, and the second member includes a fifth plate portion facing, when the second member is attached to the first member, the third plate portion and a sixth plate portion facing, when the second member is attached to the first member, the fourth plate portion.

11. A recording apparatus comprising a recording unit including a recording portion that performs recording by ejecting liquid onto a medium; and a liquid housing unit that houses the liquid to be supplied to the recording portion and that is located under the recording unit, wherein the liquid housing unit includes the frame unit according to claim 1.

12. The recording apparatus according to claim 11, further comprising a tube that supplies the liquid from the liquid housing unit to the recording portion, wherein the tube is routed through the cutout portion.

13. The recording apparatus according to claim 12, wherein when fixing of the second member to the first member is completed, the first facing portion is in contact with the first receiving portion, and the second facing portion is in contact with the second receiving portion.

14. The recording apparatus according to claim 13, wherein the protruding portion includes a first inclined portion that guides, when the second member is to be attached to the first member, the first facing portion to the first receiving portion, and a second inclined portion that guides, when the second member is to be attached to the first member, the second facing portion to the second receiving portion.

15. The recording apparatus according to claim 14, wherein the second member is fixed to the first member by screwing the second plate portion to the first plate portion, and in a process of the fixing by screwing, the protruding portion enters the cutout portion while the first inclined portion and the second inclined portion expand a gap between the first receiving portion and the second receiving portion.

16. The recording apparatus according to claim 12, wherein the first receiving portion of the first member is provided in a first groove portion extending in the first direction, the second receiving portion of the first member is provided in a second groove portion extending in the first direction, and when the second member is attached to the first member, the protruding portion enters the first groove portion and the second groove portion.

17. The recording apparatus according to claim 16, wherein the first groove portion of the first receiving portion and the second groove portion of the second receiving portion include restricting portions that protrude inside the first groove portion and the second groove portion, and the restricting portions sandwich the protruding portion.

18. The recording apparatus according to claim 12, wherein the second member is attached to the first member from an outer surface side of the first plate portion.

19. The recording apparatus according to claim 12, wherein the second member is attached to the first member from an inner surface side of the first plate portion.

20. The recording apparatus according to claim 12, wherein the first direction is a vertical direction.

* * * * *